US006232584B1

(12) United States Patent
Meyer

(10) Patent No.: US 6,232,584 B1
(45) Date of Patent: May 15, 2001

(54) SYSTEM FOR CONTROLLING A SELF CLEANING OVEN HAVING CATALYST TEMPERATURE CONTROL

(75) Inventor: Robert William Meyer, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/464,029

(22) Filed: Dec. 15, 1999

(51) Int. Cl.[7] ..... H05B 1/02

(52) U.S. Cl. ..... 219/497; 219/413; 219/393; 219/396; 219/391

(58) Field of Search ..... 219/497, 413, 219/393, 412, 391, 392, 501, 395–398, 483

(56) References Cited

U.S. PATENT DOCUMENTS

| | | | | |
|---|---|---|---|---|
| 3,962,561 | | 6/1976 | Maitenaz | 219/391 |
| 4,481,404 | * | 11/1984 | Thomas et al. | 219/398 |
| 4,775,777 | * | 10/1988 | Sinn | 219/397 |
| 4,852,544 | * | 8/1989 | Williams et al. | 126/39 BA |
| 4,954,694 | | 9/1990 | Nagai et al. | 219/413 |
| 5,026,971 | * | 6/1991 | Payne et al. | 219/483 |
| 5,083,010 | * | 1/1992 | Henry et al. | 219/413 |
| 5,286,943 | | 2/1994 | Has | 219/413 |
| 5,343,020 | * | 8/1994 | Waigand et al. | 219/413 |
| 5,826,520 | * | 10/1998 | Mainord | 110/342 |

FOREIGN PATENT DOCUMENTS

| | | |
|---|---|---|
| 196 06 571 | 8/1997 | (DE) . |
| 878667A2 | 11/1998 | (EP) . |

* cited by examiner

*Primary Examiner*—Teresa Walberg
*Assistant Examiner*—Jeffrey Pwu
(74) *Attorney, Agent, or Firm*—Joel M. Van Winkle; Robert O. Rice; Thomas J. Roth

(57) ABSTRACT

A method and apparatus is provided for operating a self cleaning oven wherein the monitoring of exothermic chemical reactions within a catalyst can be used to determine when the combustion of food material is complete, in order to terminate a self cleaning cycle. During a self clean cycle, an oven cavity is heated to and maintained at an oven clean temperature suitable for oven cleaning. A catalyst is disposed within an exhaust passage of an oven cavity and the amount of heat generated within the catalyst is sensed. The self clean cycle is terminated a predetermined time after heat generation within the catalyst ceases.

18 Claims, 3 Drawing Sheets

SYSTEM FOR CONTROLLING A SELF CLEANING OVEN HAVING CATALYST TEMPERATURE CONTROL

BACKGROUND OF THE INVENTION

1. Field of the Invention

The present invention relates to cooking ovens, and more particularly to a self-cleaning system for an oven which is capable of automatically eliminating food soils accumulated on its walls by a pyrolytic process at a high temperature.

2. Description of the Related Art

It is well known, as disclosed in U.S. Pat. Nos. 3,962,561 and 4,481,404, that cooking ovens such as electric ovens, gas ovens and convection microwave ovens can not only be used for normal cooking but also can pyrolytically eliminate food soils attached to its walls during the normal cooking. The pyrolytic elimination can be effected by heating and maintaining the cooking chamber at a high cleaning temperature—such as between 800° F. –850° F. —for one to four hours. As soils are pyrolytically degraded, exhaust products are produced such as water vapor, carbon monoxide, carbon dioxide and others including partially combusted or degraded soil particles which produce smoke and odors. It is known that a catalyst, located in the exhaust duct of an oven, can be used to further degrade or oxidize the partially combusted products, thereby minimizing smoke and odors that are exhausted into the ambient atmosphere—typically a kitchen.

The typical self clean cycle is effected by having a user select a self clean option. Initiation of the self clean cycle will set a high control temperature for the oven, cause the oven door to be locked immediately or at some predetermined time or temperature and proceed to heat the oven cavity to a relatively high temperature for a predetermined time before ending the heating cycle, allowing cooling to occur and then releasing the door lock as an end to the self clean cycle.

The cleaning time actually needed to pyrolytically clean a cooking chamber greatly depends on the amount of food soils in the cooking chamber. In the case of light food soils, the soil-elimination is sufficiently effected with a relatively short cleaning period, such as a cleaning time of about one hour (about ½ hour for heating-up and about ½ hour for cooling-off). On the other hand, in the case of heavy food soils, the chamber temperature must be maintained at the cleaning temperature for about three hours. As a result, the cleaning time is about four hours for a worst case/heavy food soil condition (about ½ hours for heating-up, about three hours for keeping the cleaning temperature and about ½ hours for cooling-off).

In order to ensure that the self clean cycle adequately cleans the oven chamber, the self clean time period is commonly determined by assuming a worst case cycle. Accordingly, the predetermined self cleaning cycle time is generally set at about 4 hours. Setting the self clean cycle under a worst case analysis wastefully consumes energy and unnecessarily requires long cleaning periods.

To address this problem of wasteful energy use during self clean, there have been some past attempts to monitor the progress of a self clean cycle and to control the duration of a self clean cycle to only the time actually needed to degrade and remove soils from the oven chamber. For example, U.S. Pat. No. 4,954,694, discloses a system wherein a gas sensor monitors the exhaust gases produced during a self clean cycle and determines the self clean heating time in response to the exhaust gas component variation.

SUMMARY OF THE INVENTION

The present invention is directed to an oven system which is capable of monitoring the progress of a self clean operation and controlling the duration of the self clean operation in response to sensed conditions. In particular, the present invention takes advantage of the operation of a catalyst positioned within an oven exhaust passage for oxidizing smoke and odors which result from the self clean operation. It has been observed that heat is generated as a result of the exothermic chemical reactions which occur on the catalyst surface as the catalyst stimulates the oxidation of partially combusted soil products pyrolytically cleaned from the oven cavity. As the exothermic chemical reaction occurs on the catalyst, the surface temperature of the catalyst and the temperature of the exhaust gases after they pass through the catalyst are greater than the temperature of the exhaust gases before they enter the catalyst area. The amount of heat generated by the catalyst and its corresponding increase in temperature is related to the amount of material being combusted within the oven cavity. If combustion of soils within the cavity is occurring, heat is generated on the catalyst whereas, upon completion of soil combustion, heat is no longer generated on the catalyst. It should be noted that upon completion of soil combustion, cleaning may still be occurring but since combustion is complete, there is nothing left to react on the catalyst.

Accordingly, a method and apparatus is provided for operating a self cleaning oven wherein the monitoring of exothermic chemical reactions within a catalyst can be used to determine when the combustion of food material is complete, in order to terminate a self cleaning cycle.

More particularly, the present invention is directed to a self cleaning oven having an oven cavity or cooking chamber and a heating device for supplying heat into the oven cavity. An exhaust passage extends from the cooking chamber and leads to the ambient atmosphere. A catalyst is disposed in the exhaust passage. A first temperature sensor senses the catalyst inlet temperature and a second temperature sensor senses the catalyst surface or outlet temperature. A controller controls the oven in accord with a method of operation that includes accepting an input to begin a self cleaning operation. The heating device is then controlled to heat and maintain the oven cavity at an oven clean temperature suitable for oven cleaning. The catalyst inlet temperature ($T_i$) and the catalyst surface or outlet temperature ($T_o$) are sensed. The self clean cycle is terminated a predetermined time after the catalyst outlet temperature ($T_o$) has exceeded and then fallen below the catalyst inlet temperature ($T_i$).

The present invention may include initially setting a timer to control the length of the self clean cycle equal to a full cycle value ($t_{fc}$). The controller monitors to determine when the oven cavity has reached the oven clean temperature. If the catalyst outlet temperature ($T_o$) is not greater than the catalyst inlet temperature ($T_i$) before the oven cavity reaches the oven clean temperature, the timer is re-set to a shortened self clean time period ($t_s$), less than the full cycle valve and the self clean cycle is terminated when the timer counts down the shortened self clean period.

Additionally, the controller may re-set the timer equal to a run out period ($t_{ro}$), less than the full cycle valve, if the catalyst outlet temperature ($T_o$) exceeds the catalyst inlet temperature ($T_i$) after the oven clean temperature has been established and then falls below the catalyst inlet temperature ($T_i$). In such case, the self clean cycle is terminated when the timer counts down the run out period ($t_{ro}$).

DESCRIPTION OF THE PREFERRED EMBODIMENT

Figure 1:
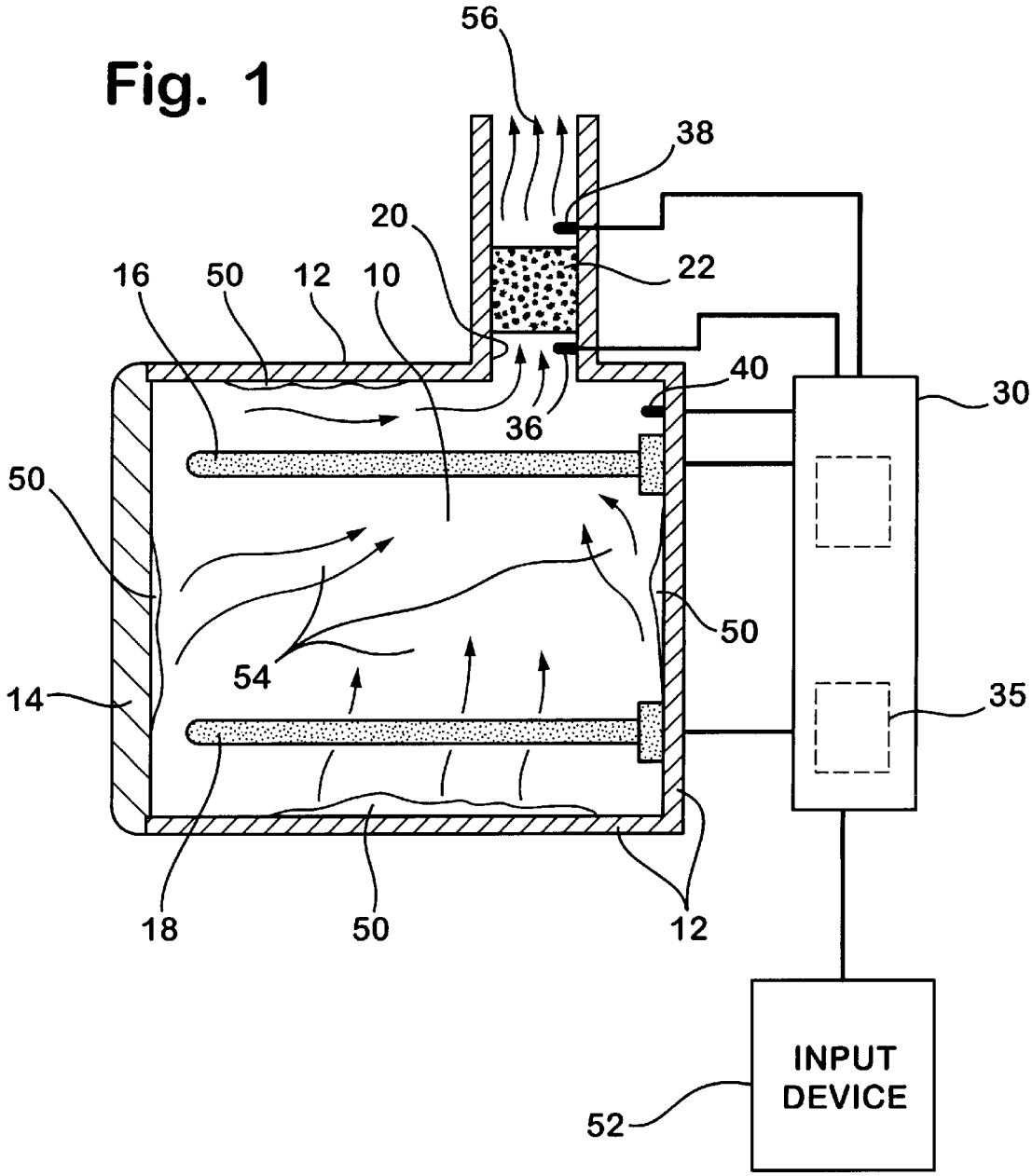
FIG. 1 is a schematic side section of an oven incorporating the principles of the present invention.

Referring now to FIG. 1, there is illustrated a cooking oven according to an embodiment of the present invention which is shown as comprising a cooking chamber or cavity 10 surrounded with walls 12 and a front door 14. Upper and lower electric heating elements 16, 18 respectively, are shown disposed in the cooking chamber or 10 so as to extend from one wall 12 in substantial parallel to each other. The heating elements may be disposed below the bottom of the cavity 10 for supplying heat into the cavity 10. Alternatively, the oven may have gas burners located below or in the bottom of the oven cavity 10.

An exhausting passage 20 is coupled to the cooking chamber 10 to exhaust the cooking chamber 10 atmosphere to the ambient atmosphere (typically a kitchen). In the exhausting passage 20 is provided an oxidizing catalyst 22 which may be made of microscopic particles of platinum, palladium, rhodium and the like. Also included in the cooking oven is a controller 30, such as a microprocessor, connected to the upper and lower electric heating devices 16, 18 which in turn supply heat into the cooking chamber 10 under control of the electric circuit 30. The controller 30 may include a memory portion 34 and a timer 35.

Various sensors are positioned within the oven to provide temperature input to the controller 30 for use in controlling the oven operation. Within the exhausting passage 20 are positioned a first temperature sensor 36 and a second temperature sensor 38. The first temperature sensor 36 is positioned adjacent the inlet side of the catalyst 22, for sensing the temperature of exhaust or vented gas before that gas enters the catalyst area. The second temperature sensor 38 is positioned adjacent the outlet side of the catalyst 22, for sensing the temperature of the exhaust or vented gas after that gas enters the catalyst area. The second temperature sensor 38 may be positioned downstream of the catalyst or may also be provided affixed directly to the surface of the catalyst 22 or may be disposed within the catalyst 22.

A chamber temperature sensor 40 is also typically provided, so as to input information for cooking and heating control. The chamber temperature sensor 40 is disposed in the cooking chamber 10 to detect the temperature therein. The first temperature sensor 36 and the chamber temperature sensor 40 may be combined in one sensor such that a single sensor may be provided for sensing the chamber temperature and the temperature of exhaust gas before entering the catalyst area.

When, as shown in FIG. 1, food soils 50 are accumulated on the walls 12, a self clean cycle may be initiated via an input device 52, such as a self clean switch or button, operated by the oven user. When an operator pushes the input device 52, one or more of the heating elements 16 and 18 are energized to cause the chamber temperature to start to be increased from a room temperature up to the cleaning temperature of about 825° F., for example. As the chamber temperature increases, the food soils 50 begin to be degraded so as to generate degraded products 54 such as smoke, odors and gases such as water vapor, carbon monoxide, carbon dioxide, hydrocarbon and others. The smoke and odors typically comprise partially combusted soil particles.

As mentioned above, the chamber atmosphere, including the degraded products 54, is exhausted through the exhausting passage 20 to the ambient atmosphere. However, in response to contact of the chamber atmosphere with the oxidizing catalyst 22, the degraded products 54 are oxidized thereby to be converted to primarily water vapor, carbon dioxide and carbon monoxide. As a result, a cleaned atmosphere 56 not including the dirty degraded products 54 is exhausted to the ambient atmosphere.

The present invention takes advantage of the operation of the catalyst to control the duration of the self clean cycle. In particular, it has been observed that heat is generated as a result of the exothermic chemical reactions which occur on the catalyst surface as the catalyst oxidizes the degraded products 54. As the exothermic chemical reaction occurs on the catalyst, the temperature of the exhaust gases after they pass through the catalyst—referred to herein as the catalyst outlet temperature $T_o$—are greater than the temperature of the exhaust gases before they enter the catalyst area—referred to herein as the catalyst inlet temperature $T_i$. The amount of heat generated by the catalyst and its corresponding increase in temperature is related to the amount of material being combusted on the catalyst which is related to degree of incomplete combustion in the cavity. If combustion of soils within the cavity 10 is occurring, heat is generated on the catalyst 22 whereas, upon completion of soil combustion, heat is no longer generated on the catalyst.

Figure 2:
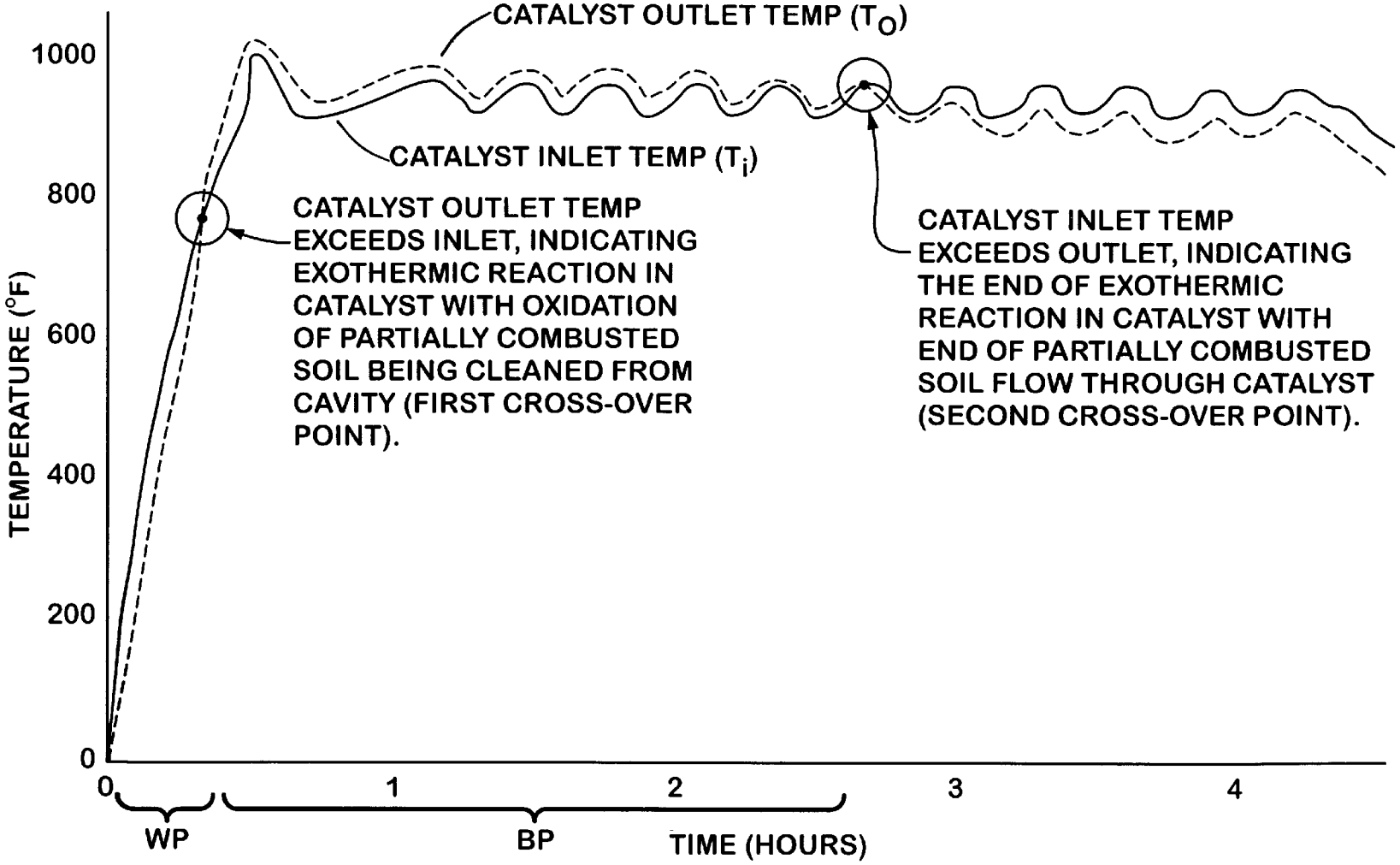
FIG. 2 is a graphic illustration of temperature of the catalyst inlet and the catalyst outlet during a typical self clean cycle wherein soils are pyrolytically cleaned.

FIG. 2 graphically illustrates the catalyst inlet temperature $T_i$ and the catalyst outlet temperature $T_o$ during a typical self clean cycle. During an initial warm up time period (WP), one or both of the heating elements 16 and 18 are energized to heat the interior cavity 10 up to a temperature at which soil begin to pyrolytically degrade. During this warm up time period (WP), both the catalyst inlet temperature $T_i$ and the catalyst outlet temperature $T_o$ increase due to the increase in temperature of the cavity 10. However, due to thermal losses through the exhausting passage or duct 20 and due to thermal losses through the catalyst 22, the outlet temperature $T_o$ is marginally less than the inlet temperature $T_i$. As the cavity 10 temperature increases, soils begin to degrade and burn off. As a result, as discussed above, exothermic reactions on the catalyst 22 generate heat and cause the catalyst to increase in temperature. As a result, after the initiation of soil combustion which generate partially combusted soil particles, the outlet temperature $T_o$ exceeds the inlet temperature $T_i$ at a first cross-over point.

Following the warm up time period (WP), a soil burn off period (BP) occurs. During this period, soils are being burned off and partially combusted soils are oxidized within the catalyst 22. Accordingly, the outlet temperature $T_o$ remains marginally above the inlet temperature $T_i$. However, at some point, the cleaning within the cavity 10 no longer generates partially combusted soil particles. As a result, exothermic reactions cease occurring on the catalyst 22 and the outlet temperature $T_o$ falls marginally below the inlet temperature $T_i$ at a second cross-over point. After the second cross-over point, the controller 30 causes the self clean cycle to continue for a predetermined period of time—determined analytically or experimentally—at the conclusion of which the self clean cycle is terminated.

It can be understood by one skilled in the art that the duration between the first cross-over point and the second cross-over point varies in accord with the amount of soils which are present in the oven cavity 10. If there is a large amount of soil in the oven cavity, the time between the first cross-over point and second cross over point may be relatively long. Correspondingly, if there is only a small amount of soil, the time between the first cross-over point and second cross over point will be relatively short. Accordingly, the duration of the self clean cycle can be controlled by monitoring whether the catalyst is oxidizing partially combusted soils—and thereby generating heat.

Figure 3:
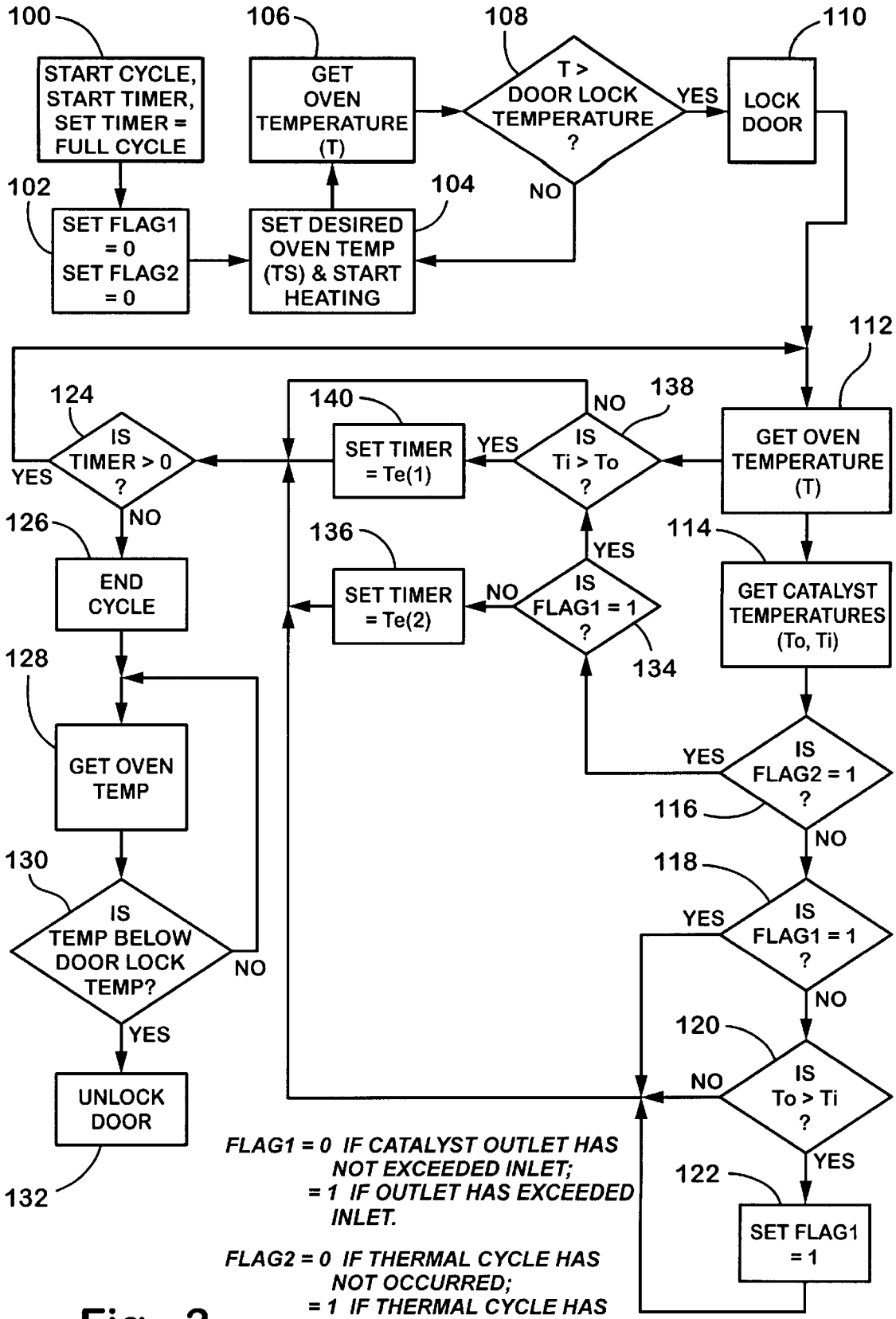
FIG. 3 is a flow chart for describing an example of a cleaning time control operation for the clean cycle in accordance with the principles of the present invention.

FIG. 3 illustrates in a flow chart form the steps that may be taken in implementing the present invention. In step 100, the self clean cycle is initiated via selection by the user through the input device 52 wherein the timer 35 is set at a full cycle value ($t_{fc}$), retrieved from memory 34. Flag1 and flag2 are set to 0 at step 102. The controller 30 then retrieves the oven clean temperature from the memory 34, typically set at approximately 825° F., and energizes one or both heaters 16, 18 to heat the cavity 10 up to the desired clean temperature, as shown in step 104. As can be understood by one skilled in the art, the controller heats the cavity 10 up to the desired clean temperature and then maintains the cavity within a temperature band, such as +/−25° F., about the self clean temperature through thermal cycling which is achieved by energizing and de-energizing the heating elements 16, 18. The door 14 is locked shut in response to the oven temperature exceeding a door lock temperature, such as 400° F., shown in steps 106, 108 and 110.

At step 112, the controller 30 receives input from chamber temperature sensor 40 to get the oven chamber temperature. Subsequently, at step 114, the controller receives input from first temperature sensor 36 and the second temperature sensor 38 for getting the inlet temperature $T_i$ and the outlet temperature $T_o$. At step 116, the controller 30 queries whether thermal cycling has occurred—indicated that the self clean temperature has been achieved. If the self clean temperature has not been reached and thermal cycling cycle has not yet occurred, control passes through steps 118, 120, 122 and 124, setting flag1=1 if the outlet temperature $T_o$ exceeds the inlet temperature $T_i$. If the timer 35 counts down through the full cycle value ($t_{fc}$) before thermal cycling occurs, then the self clean cycle is terminated and the door is unlocked as shown in steps 126, 128, 130 and 132.

Once thermal cycling is initiated, the controller 30 checks to see if flag1=1 at step 134. If flag1=0, indicating that the outlet temperature $T_o$ has not exceeded the inlet temperature $T_i$, this indicates that there are insufficient soils in the cavity 10 to create sufficient degraded products to produce exothermic reactions within the catalyst 22. In such a case, as shown in step 136, the controller sets the timer 35 to a shortened self cleaning value ($t_s$)—determined by experiment to be an adequate pyrolytic cleaning time for light soil conditions.

If flag=1, indicating that the outlet temperature $T_o$ has exceeded the inlet temperature $T_i$, the controller 30 inquires whether the second cross-over point has been reached wherein the outlet temperature $T_o$ has fallen back below the inlet temperature $T_i$, as shown in step 138. Control loops through step 124 until the timer counts down to zero or until the outlet temperature $T_o$ falls back below the inlet temperature $T_i$. Upon sensing the second cross-over point, the timer 35 is set to a run out value ($t_{ro}$)—determined by experiment to be an adequate time to complete cleaning after the second cross-over point has been reached—as shown in step 140.

When the timer 35 counts completely down—regardless of whether the timer is set to full cycle value ($t_{fc}$), the shortened self clean value ($t_s$) or the run out value ($t_{ro}$), the self clean cycle is terminated and the door is subsequently unlocked as shown in steps 128, 130 and 132.

Although the preferred embodiment has been described, the present invention may be implemented in an oven in many different ways and still fall within the scope of the claims provided below. For example, step 116, wherein the controller queries whether thermal cycling has occurred, could be replaced by any step which determines whether the oven clean temperature has been achieved. For example, the controller could directly sense the oven cavity temperature in step 116. Alternatively, step 116 could be replaced by allowing a predetermined amount of time lapse—sufficient to ensure that the oven has reached a self clean temperature.

Where the first temperature sensor 36 and second temperature sensor 38 are located may likewise be varied—as long as these sensors give some output which is indicative or related to heat generation on the catalyst 22. Similarly, the invention may be practiced by measuring the catalyst temperature directly, rather than measuring the catalyst outlet temperature. Additionally, the catalyst 22 may be configured to fully oxidize the degraded products which are exhausted from the oven cavity 10 or the catalyst 22 may be configured to oxidize only a portion of the degraded products which are exhausted from the oven cavity 10. For example, the catalyst 22 may be sized to serve primarily as a combustion sensor—not as a structure for preventing smoke and odor from exhausting from the oven.

The present invention may be beneficially embodied in either a gas or electric oven. In the case of an oven, it is likely that the catalyst would be a relatively small pellet or unit—used solely as a combustion sensor.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

I claim:

1. A method for controlling a self cleaning oven having a cooking chamber, a heating device for supplying heat into said cooking chamber, an exhaust passage from said cooking chamber leading to atmosphere, a catalyst disposed in the exhaust passage, a temperature sensor for sensing the catalyst inlet temperature and a temperature sensor for sensing the catalyst outlet temperature, and a controller for controlling said heating device, the method comprising the steps of:

accepting an input at the controller to begin a self cleaning operation;

controlling said heating device to heat and maintain the oven cavity at an oven clean temperature suitable for oven cleaning;

sensing the catalyst inlet temperature ($T_i$);

sensing the catalyst outlet temperature ($T_o$); and initiating a termination of the self cleaning cycle once the catalyst outlet temperature has exceeded and then falls below the catalyst inlet temperature ($T_i$).

2. The method of controlling a self cleaning oven according to claim 1, further comprising:

setting a timer to control the length of the self clean cycle equal to a full cycle value ($t_{fc}$);

monitoring to determine when the oven cavity has reached the oven clean temperature;

re-setting the timer equal to a shortened self clean time value ($t_s$), less than the full cycle valve, if the catalyst outlet temperature ($T_o$) is not greater than the catalyst inlet temperature ($T_i$) before the oven cavity has reached the oven clean temperature; and terminating the self clean cycle when the timer counts down the shortened self clean period.

3. The method of controlling a self cleaning oven according to claim 2, further wherein the step of monitoring when the oven cavity has reached the oven clean temperature comprises the step of:

monitoring to determine when thermal cycling occurs.

4. The method of controlling a self cleaning oven according to claim 2, further comprising:

re-setting the timer equal to a run out value ($t_{ro}$), less than the full cycle valve, if the catalyst outlet temperature ($T_o$) exceeds the catalyst inlet temperature ($T_i$) after the oven cavity has reached the oven clean temperature and then falls below the catalyst inlet temperature ($T_i$); and terminating the self clean cycle when the timer counts down the run out value ($t_{ro}$).

5. The method of controlling a self cleaning oven according to claim 2, further wherein the step of monitoring when the oven cavity has reached the oven clean temperature comprises the step of:

sensing the oven cavity temperature to determine when the oven clean temperature has been reached.

6. The method of controlling a self cleaning oven according to claim 1, wherein the step of initiating a termination of the self clean cycle further comprises:

maintaining the oven cavity at a temperature suitable for cleaning for an additional predetermined period after the catalyst outlet temperature ($T_o$) exceeds and then falls below the catalyst inlet temperature ($T_i$); and then terminating operation of said heating device.

7. The method of controlling a self cleaning oven according to claim 1, wherein the step of sensing the catalyst outlet temperature ($T_o$) comprises the step of sensing the temperature of the catalyst.

8. A self cleaning oven, comprising:

a cooking chamber;

a heating device for supplying heat into the oven cavity;

an exhaust passage extending from the oven cavity and leading to external atmosphere;

a catalyst disposed in the exhaust passage, the exhaust passage and catalyst forming a catalyst inlet area within the exhaust passage on the inlet side of the catalyst and a catalyst outlet area within the exhaust passage on the outlet side of the catalyst;

a first temperature sensor for sensing the catalyst inlet area temperature ($T_i$);

a second temperature sensor for sensing the catalyst outlet area temperature ($T_o$); and a controller for controlling the oven wherein a self clean cycle will be initiated in response to a user input to energize the heating device to heat and maintain the oven cavity at a temperature suitable for oven cleaning and terminate the self cleaning cycle a predetermined time after the catalyst outlet temperature ($T_o$) has exceeded and then fallen below the catalyst inlet temperature ($T_i$).

9. The self cleaning oven according to claim 8, further comprising:

a third temperature sensor disposed in the oven cavity for sensing the oven cavity temperature.

10. The self cleaning oven according to claim 8, further wherein:

the first temperature sensor is positioned within the exhaust passage and is used to measure the oven cavity temperature.

11. The self cleaning oven according to claim 8 further wherein the second temperature sensor is disposed on the catalyst and senses the catalyst temperature ($T_o$).

12. The self cleaning oven according to claim 8 further wherein the heating device is an electric heating element.

13. The self cleaning oven according to claim 8 further wherein the heating device is a gas burner.

14. A method for controlling a self cleaning oven having a cooking chamber, a heating device for supplying heat into said cooking chamber, an exhaust passage from said cooking chamber leading to atmosphere, a catalyst disposed in the exhaust passage, and a controller for controlling said heating device, the method comprising the steps of:

accepting an input at the controller to begin a self cleaning operation;

controlling said heating device to heat and maintain the oven cavity at an oven clean temperature suitable for oven cleaning;

sensing whether the catalyst is oxidizing partially combusted soil; and initiating a termination of the self cleaning cycle after the catalyst is no longer oxidizing partially combusted soils.

15. The method of controlling a self cleaning oven according to claim 14, further wherein a temperature sensor is provided for sensing the amount of heat generated on the catalyst, the method further comprising the steps of:

sensing whether heat is being generated on the catalyst to determine whether the exothermic chemical reactions are occurring within the catalyst.

16. The method of controlling a self cleaning oven according to claim 14, further comprising:

setting a timer to control the length of the self clean cycle equal to a full cycle value ($t_{fc}$);

monitoring to determine when the oven cavity has reached the oven clean temperature;

re-setting the timer equal to a shortened self clean time value ($t_s$), less than the full cycle valve, if the catalyst does not generate any heat before the oven cavity reaches the oven clean temperature; and terminating the self clean cycle when the timer counts down the shortened self clean period.

17. The method of controlling a self cleaning oven according to claim 16, further wherein the step of monitoring when the oven cavity has reached the oven clean temperature comprises the step of:

monitoring to determine when thermal cycling occurs.

18. The method of controlling a self cleaning oven according to claim 14, further comprising:

re-setting the timer equal to a run out value ($t_{ro}$), less than the full cycle valve, when heat is no longer being generated within the catalyst; and terminating the self clean cycle when the timer counts down the run out value ($t_{ro}$).

* * * * *